US005588868A

United States Patent [19]

Tsuji et al.

[11] Patent Number: 5,588,868

[45] Date of Patent: Dec. 31, 1996

[54] STRAND CABLE PRESS-CONTACTING TERMINAL

[75] Inventors: Masanori Tsuji; Kimihiro Abe; Osamu Sugiyama; Hiroshi Yamamoto, all of Haibara-gun, Japan

[73] Assignee: Yazaki Corporation, Tokyo, Japan

[21] Appl. No.: 412,119

[22] Filed: Mar. 28, 1995

[30] Foreign Application Priority Data

Mar. 29, 1994 [JP] Japan ..... 6-058538

[51] Int. Cl.[6] ..... H01R 4/24

[52] U.S. Cl. ..... 439/397

[58] Field of Search ..... 439/395, 397, 439/399, 400

[56] References Cited

U.S. PATENT DOCUMENTS 5,380,218 1/1995 Yamamoto et al. ..... 439/395

FOREIGN PATENT DOCUMENTS 60-142463 9/1985 Japan .

*Primary Examiner*—Neil Abrams
*Assistant Examiner*—Yong Kim
*Attorney, Agent, or Firm*—Nikaido, Marmelstein, Murray & Oram LLP

[57] ABSTRACT

A strand cable press-contacting terminal primarily comprising: a pair of fore and aft press-contacting pieces are arranged longitudinally in the terminal fitting; an even number of twisted wires are aligned in the first external layer of said cable; and wherein said pair of fore and aft press-contacting pieces are spaced each other to the distance value which is obtained by multiplying a quarter of the wire strand pitch by an odd number n. Further, this invention may be a strand cable press-contacting terminal comprising: more than two pairs of press-contacting pieces are provided longitudinally in the terminal fitting; said terminal is used for plural kinds of strand cables differed in strand pitch; an even number of twisted wires are aligned in the first external layer of said each cable; and, wherein the each distance between said more than two pairs of press-contacting pieces is decided on the same value as a quarter of said each cable strand pitch being multiplied by an odd number n.

8 Claims, 10 Drawing Sheets

STRAND CABLE PRESS-CONTACTING TERMINAL

BACKGROUND OF THE INVENTION

1. Field of the Invention

This invention relates to press-contacting terminals and more particularly to press-contacting terminals having an appropriate contact area so as to connect reliably a strand cable thereto, wherein an even number of twisted wires are aligned in the first external layer of the cable having totally an odd number of wires.

2. Description of the Prior Art

Conventional press-contacting terminals for strand cables are illustrated in FIGS. 17 and 18. A press-contacting terminal 27 (or 28) has each pair of fore and aft press-contacting pieces 3,4 (or 29, 30) formed by raising up tab portions struck from a bottom wall of the terminal as shown in FIG. 17 or by inwardly bending tab portions struck from side walls of the terminal as shown in FIG. 18. A terminal contacting member 31( or 33) for a corresponding other terminal is formed forward to the fore press-contacting pieces 3 (or 29) and an insulation covered cable clamping portion 32(or 34) is formed in the back of the aft press-contacting pieces 4 (or 30). The interval L of the fore and aft press-contacting pieces 3,4 (or 29, 30) is decided in consideration of the over all length of the terminal 27(or 28) or a space laying between the terminal contacting member 31(or 33) and the insulation-covered cable clamping portion 32(or 34).

The strand cable 2 is pressed downward into a slot 35(or 36) formed between the right and left press-contacting pieces 3,3 or 4,4 (or 29,29 or 30,30). In FIG. 19, there is illustrated an example of wire press-contacting patterns in respect of a press-contacting terminal 27.

The each pair of aft press-contacting pieces 3,4 (or 29, 30) forms an upwardly open notch for receiving the insulation-covered strand cable, the notch converging downwardly and having thin edges to afford a cutting section for shearing through the cable insulation.

Further, FIGS. 20A to 20C show respectively strand cables 2,6,37 to make electric connection with terminals by press-contacting. In regard to the cables such as the type number CAVS0.5SQ (seven wires) or AVSS2SQ (thirty seven wires), around a core wire $1_0$, $5_0$, $38_0$), an even number of wires 1,5, 38 are circularly aligned in one or a plurality of layers. The strand cables 2, 6, 37 have, in each of the first external layers, six, twelve, eighteen wires respectively.

SUMMARY OF THE INVENTION

However, in the above mentioned previously known press-contacting structures in respect of the strand cables, every of the fore and aft press-contacting pieces 3,4 (or 29, 30) can, as shown in FIG. 19, make contact with, in some cases, only one wire in the first external layer of the strand cable at each of the right and left press-contacting pieces, which causes a disadvantage of a less contacting area to have an unreliable electric-continuity effect.

This invention aims, without engendering the disadvantage of the above mentioned previously known press-contacting structures, to provide a press-contacting terminal for a strand cable, wherein each pair of fore and aft press-contacting pieces 3,4 (or 29, 30) can make appropriately contact with wires 1,5, 38 so as to have a reliable electric continuity effect.

To achieve the aforementioned object, a strand cable press-contacting terminal of this invention primarily comprises: a pair of fore and aft press-contacting pieces are arranged longitudinally in the terminal fitting; an even number of twisted wires are aligned in the first external layer of the cable; and, wherein the pair of fore and aft press-contacting pieces are spaced each other to the distance value which is obtained by multiplying a quarter of the wire strand pitch by an odd number n.

Further, this invention may be a strand cable press-contacting terminal of the invention comprises: more than two pairs of press-contacting pieces are provided longitudinally in the terminal fitting; the terminal is used for plural kinds of strand cables differed in strand pitch; an even number of twisted wires are aligned in the first external layer of the each cable; and, wherein the each distance between the more than two pairs of press-contacting pieces is decided on the same value as a quarter of the each cable strand pitch being multiplied by an odd number n.

Referring to the operation of the above invention, the wires aligned in the first external layer of each of the strand cable have a 90° phase-shift difference between in one-quarter and one-half strand pitch proceeding sections. If a plurality of the wires are positioned vertically in line at both sides of the strand cable n a one-quarter strand pitch proceeding section, one of or at least one of the wires is positioned at both sides of the strand cable in a one-half strand pitch proceeding section. Accordingly, if the fore and aft press-contacting pieces are spaced to the distance of a quarter of the wire strand pitch (as a half minus a quarter equals a quarter), at least either pair of the fore and aft press-contacting pieces makes contact with a plurality of the wires at both sides of the strand cable to obtain a larger continuity area. And, the alignment of the wires in the first external layer in a three-quarters strand pitch proceeding section is similar to the one in a one-quarter strand pitch proceeding section.

Moreover, for a plurality of strand cables differed in strand pitches, more than two press-contacting pieces are provided so as to be spaced as mentioned above according to each strand pitch. It can provide a press-contacting terminal with larger continuity areas, which is used commonly for a plurality of strand cables differed in strand pitches.

DETAILED DESCRIPTION OF PREFERRED EMBODIMENT

Figures 1A, 1B:
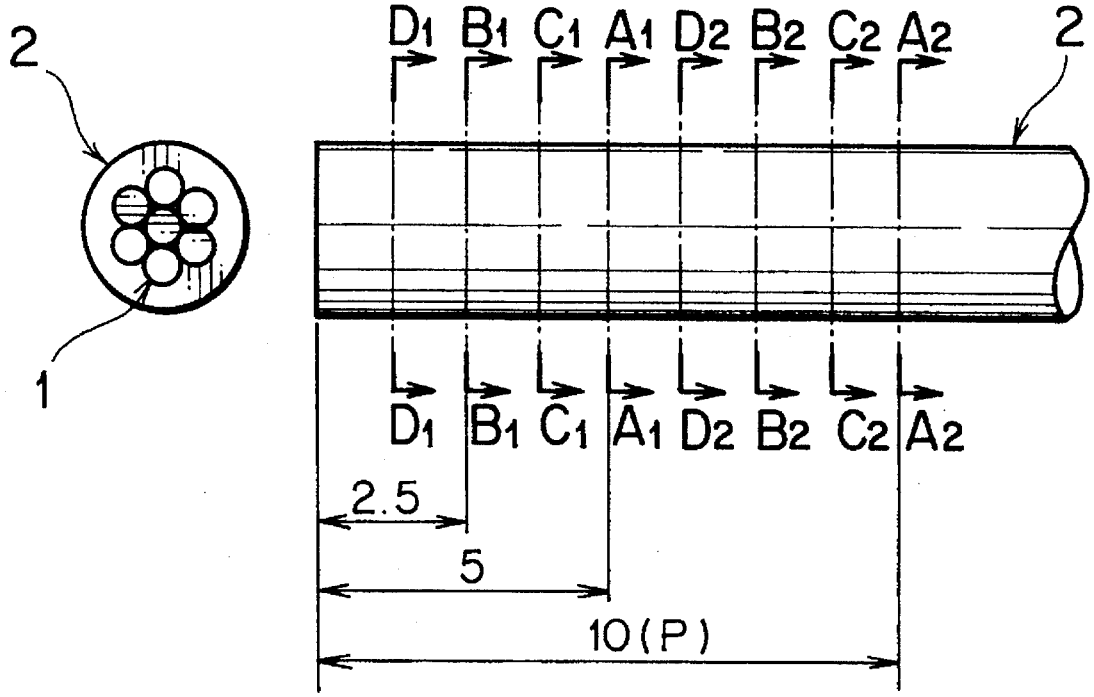
FIG. 1A is a front view of a strand cable and FIG. 1B is a top view showing longitudinal positions of sections proceeding by every one-eighth strand pitch of the strand cable in respect of this invention.

In FIGS. 1A to 2C, there is shown a strand cable 2 composing of seven wires 1 (six wires in an external layer). When the strand pitch is 10 mm in length, in FIGS. 1A and 1B, A1—A1 section of the one-half strand pitch proceeding section (5 mm proceeding section) and A2—A2 section of the one strand pitch proceeding section (10 mm proceeding section) have the same wire alignment (which is shown in FIG. 2A) as that of the front end of the strand cable, which is illustrated in FIG. 1A. In these sections, each couple of wires $\mathbf{1}_1$,$\mathbf{1}_2$ are aligned vertically at each side of the strand cable. Precisely speaking, the wire alignment of A2—A2 section is shifted by 180° in phase from that of A1—A1 section. And, both of B1—B1 section of the one-quarter strand pitch proceeding section (2.5 mm proceeding section) and B2—B2 section of the three-quarters strand pitch proceeding section (7.5 mm proceeding section) have one $\mathbf{1}_3$ of the wires at both sides of the strand cable, which is shown in FIG. 2B.

Figures 2A, 2B, 2C:
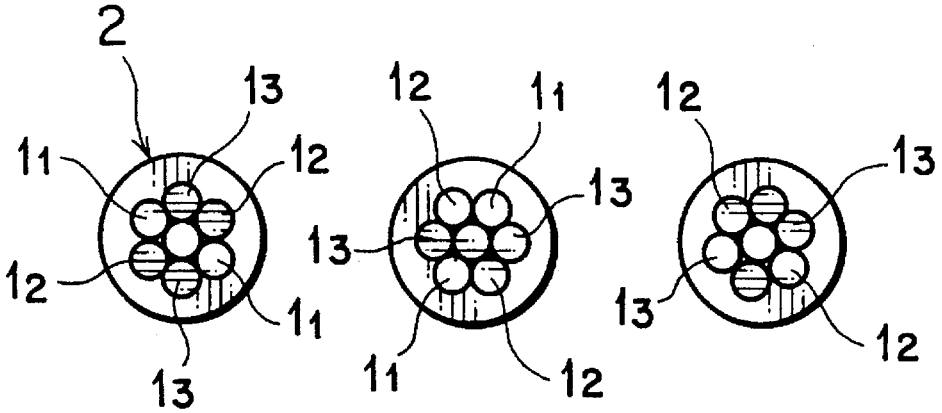
FIG. 2A is a sectional view along A1—A1 or A2—A2.
FIG. 2B is a sectional view along B1—B1 or B2—B2.
FIG. 2C is a sectional view along C1—C1, C2—C2 in respect of FIG. 1.

And, both of C1—C1 section of the three-eighths strand pitch proceeding section (3.75 mm proceeding section) and C2—C2 section of the seven-eighths strand pitch proceeding section (8.75 mm proceeding section) have each couple of wires $\mathbf{1}_2$,$\mathbf{1}_3$ at both side portion of the strand cable, wherein the each couple of wires are aligned in parallel and unsymmetrical to the other couple of wires and inclined to the center vertical line of the strand cable as shown in FIG. 2C. And, both of D1—D1 section of the eighth-strand pitch proceeding section (1.25 mm proceeding section) and D2—D2 section of the five-eighths strand pitch proceeding section (6.25 mm proceeding section) have each couple of wires $\mathbf{1}_2$,$\mathbf{1}_3$ at both sides of the strand cable, wherein the each couple of wires are inclined symmetrically (not illustrated) to those which are shown in FIG. 2C.

Figure 17:
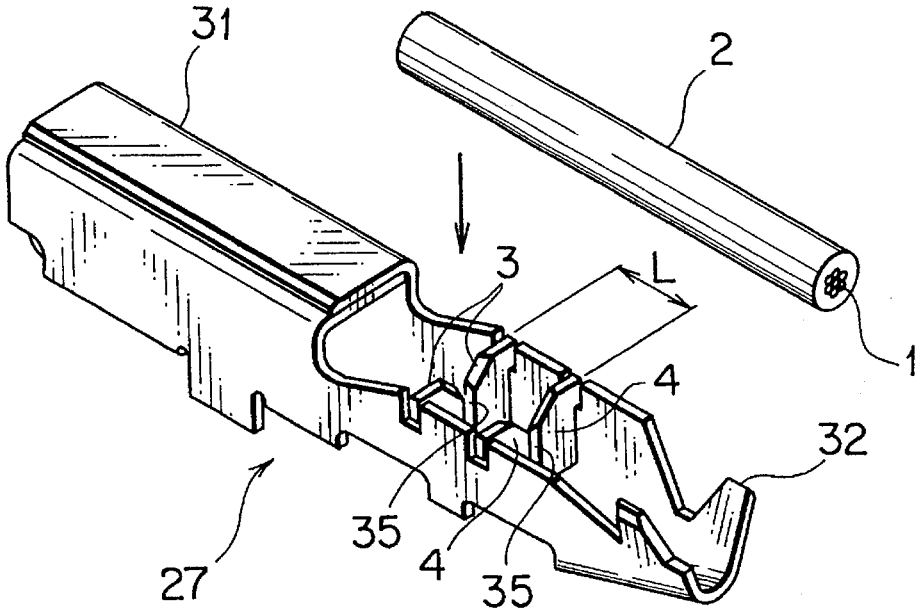
FIG. 17 PRIOR ART
FIG. 17 is a conventional press-contacting terminal.
Figure 18:
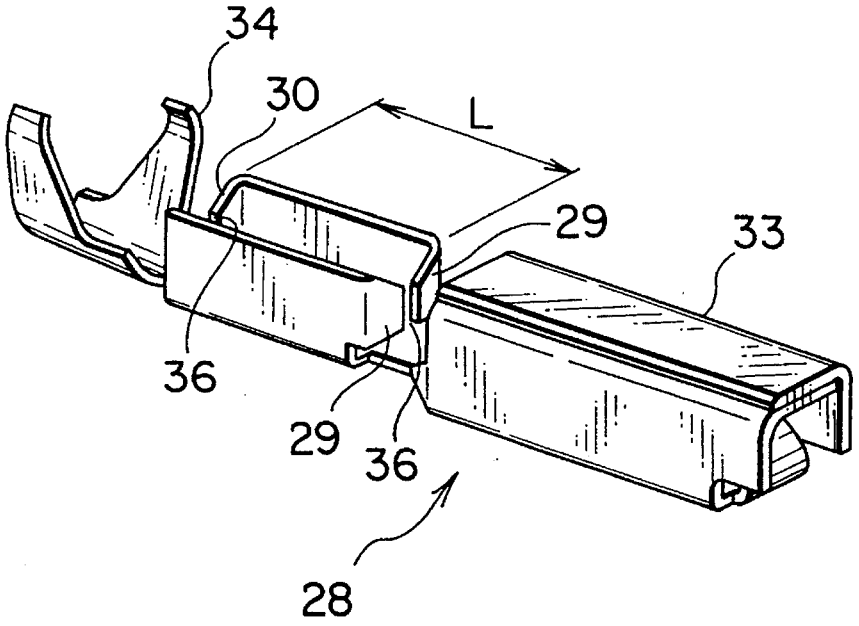
FIG. 18 PRIOR ART
FIG. 18 is another conventional press-contacting terminal.
Figure 19:
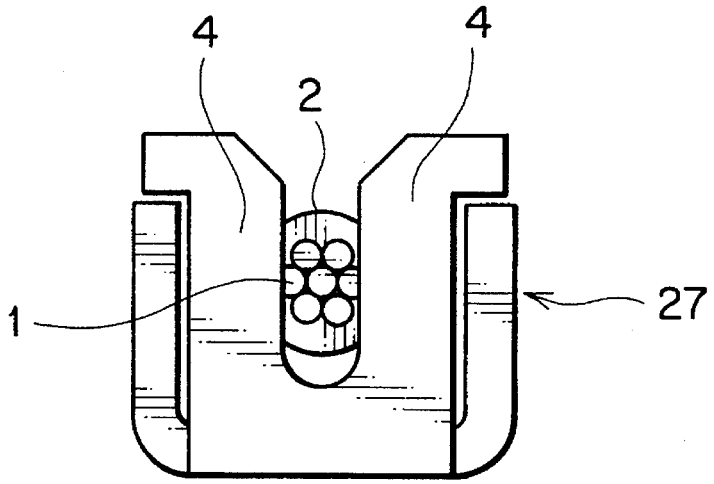
FIG. 19 PRIOR ART
FIG. 19 is a transverse cross sections showing a press-contacting state of a strand cable in the terminal illustrated in FIG. 17.
Figures 20A, 20B, 20C:
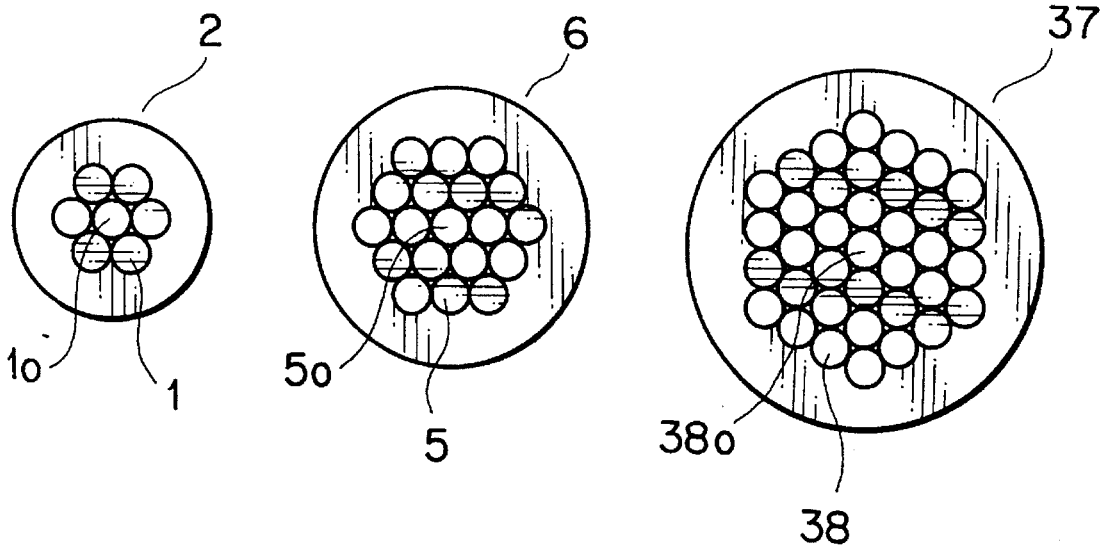
FIG. 20A, FIG. 20B, and FIG. 20C are front views of strand cables having an even number of wires in the first external layer, wherein each cable of the drawings is different from each other in numbers of wire layers.

Now, in regard to a strand cable press-contacting terminal according to this invention, at least a pair of fore and aft press-contacting pieces 3,3 and 4,4, for example, which are shown in previously-known terminals illustrated in FIGS. 17 and 18, should always be able to make contact with a plurality of wires 1 at each side portion of the strand cable to have an appropriate electric continuity. To achieve the above mentioned effect, when a strand pitch, for example, is 10 mm in length, the fore and aft press-contacting pieces 3,4 are spaced by 2.5 mm, that is a quarter of the wire strand pitch length. A general formula that determine an interval L of the fore and aft press-contacting pieces 3,4 according to a wire strand pitch P, is as follows;

$$L=P/4\times n \text{ (n is an odd number)}$$

Figure 3A:
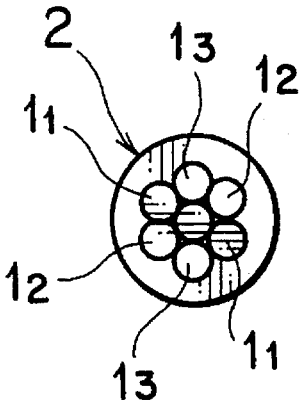
FIG. 3A is a front view of a strand cable and FIG. 3B is a top view showing longitudinal positions of sections proceeding by one half or three quarters of the strand pitch in respect of the strand cable with seven wires in respect of this invention.
Figure 3B:
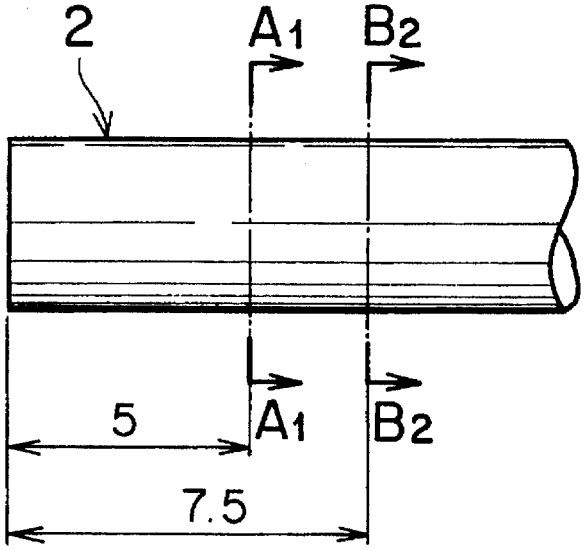
Figure 4A:
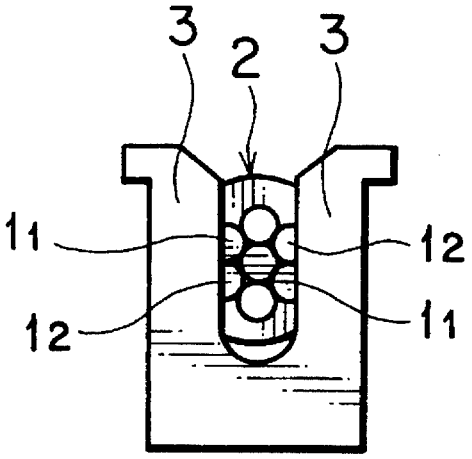
FIG. 4A and FIG. 4B are transverse cross sections showing the press-contacting states of the wires at the positions indicated in FIG. 3B.
Figure 4B:
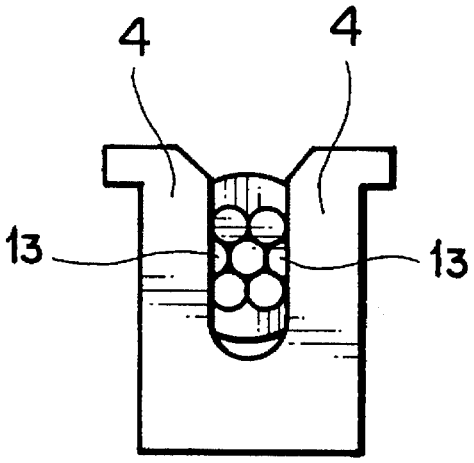

That is, as shown in FIGS. 3A and 3B, when the fore press-contacting piece 3 is positioned at A1—A1 section of a one-half strand pitch proceeding section (5 mm proceeding section), the aft press-contacting piece 4 is located at B2—B2 section of a three-quarters strand pitch proceeding section (7.5 mm proceeding section). As a result, the pair of fore press-contacting piece 3,3 can, as shown in FIG. 4A, make contact with each couple of wires $\mathbf{1}_1$, $\mathbf{1}_2$ to have a larger continuity area. While, the pair of aft press-contacting piece 4,4, as shown in FIG. 4B, make contact with only each one wire $\mathbf{1}_3$, wherein the wire alignment is shifted by 90° in phase in comparison with the one FIG. 4A.

Figure 5A:
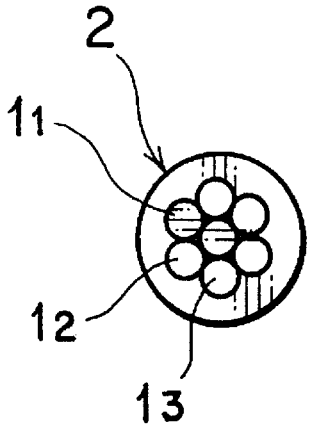
FIG. 5A is a front view of a strand cable and FIG. 5B is a top view showing longitudinal positions of sections proceeding by a quarter or a half of the strand pitch respectively in respect of the strand cable with seven wires in regard to this invention.
Figure 5B:
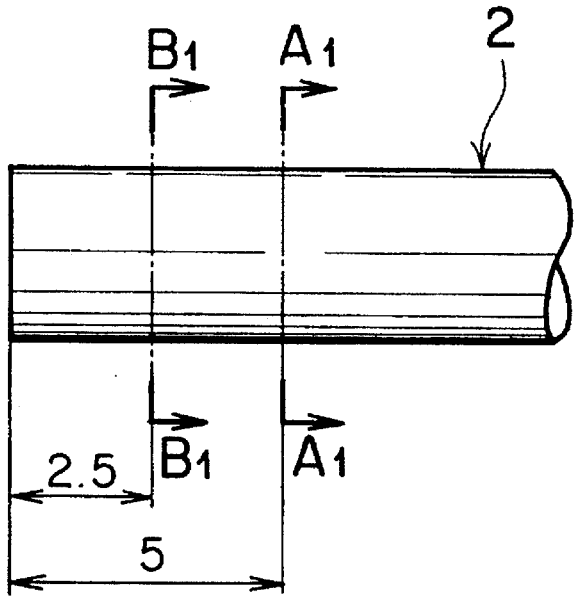
Figure 6A:
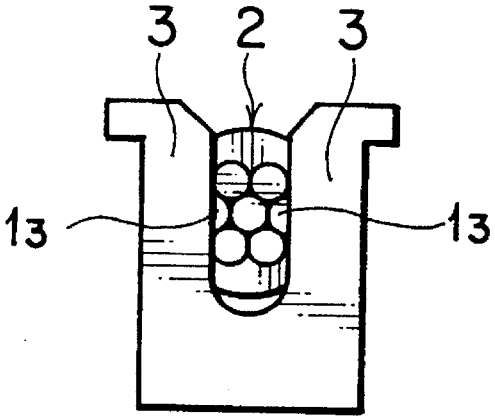
FIG. 6A and FIG. 6B are transverse cross sections showing the press-contacting state of the wires at the positions indicated in FIG. 5B.
Figure 6B:
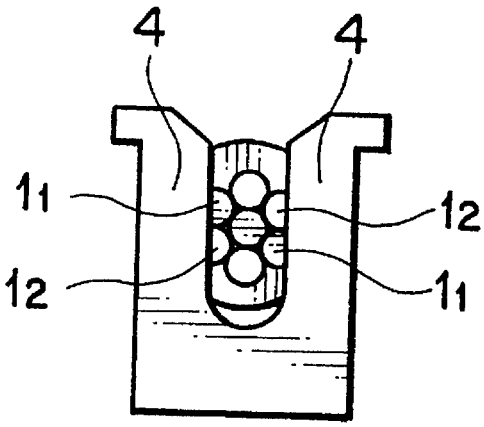

Further, as shown in FIGS. 5A and 5B, when the fore press-contacting piece 3 is positioned at B1—B1 section of a one-quarter strand pitch proceeding section (2.5 mm proceeding section) and the aft press-contacting piece 4 is located in A1—A1 section of a one-half strand pitch proceeding section (5 mm proceeding section), the pair of fore press-contacting piece 3,3 can, in contrast with that of FIG. 4 and as shown in FIG. 6A, make contact with only each one wire $\mathbf{1}_3$. While, the pair of aft press-contacting piece 4,4, as shown in FIG. 6B, make contact with each couple of wires $\mathbf{1}_1$, $\mathbf{1}_2$. B1—B1 section in FIG. 5B is shifted by 180° in phase in comparison with B2—B2 section in FIG. 3B.

Figure 7A:
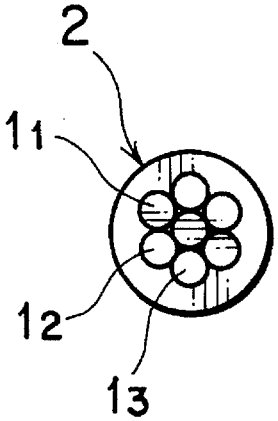
FIG. 7A is a front view of a strand cable and FIG. 7B is a top view showing longitudinal positions of sections proceeding by three eighths or five eighths of the strand pitch in respect of the strand cable with seven wires in regard to this invention.
Figure 7B:
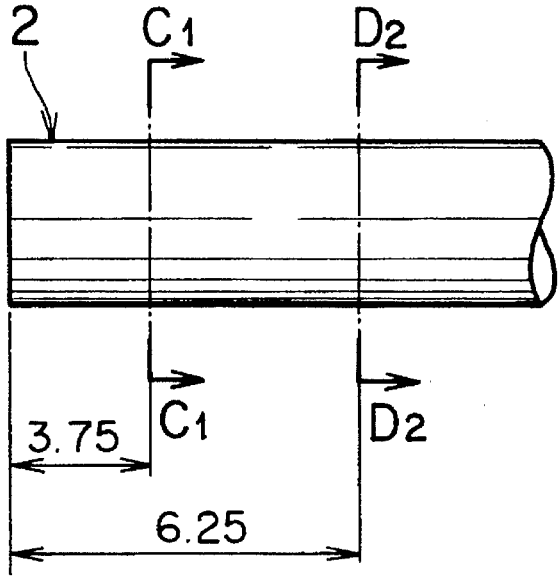
Figure 8A:
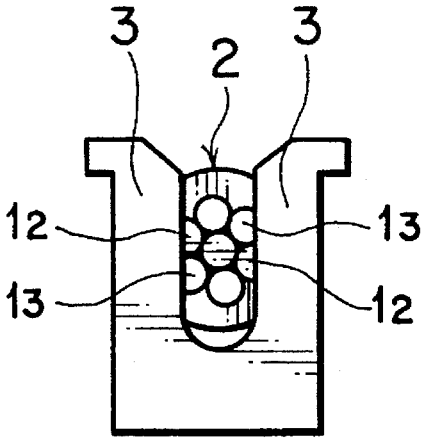
FIG. 8A and FIG. 8B are transverse cross sections showing a press-contacting state of the wires at the positions indicated in FIG. 7B.
Figure 8B:
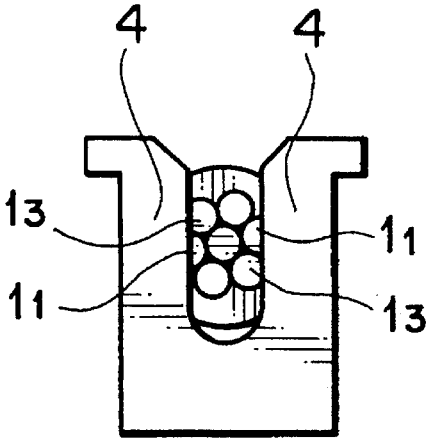
Figure 9A:
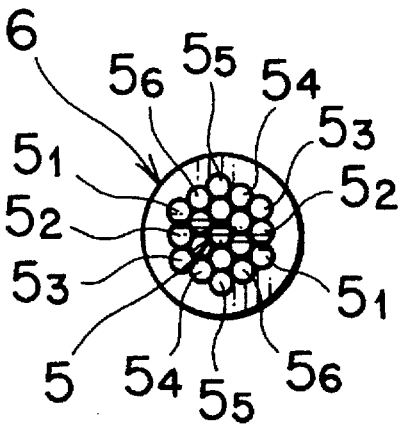
FIG. 9A is a front view of a strand cable and FIG. 9B is a top view showing longitudinal positions of sections proceeding by a half or three quarters of the strand pitch in respect of the strand cable with nineteen wires in regard to this invention.
Figure 9B:
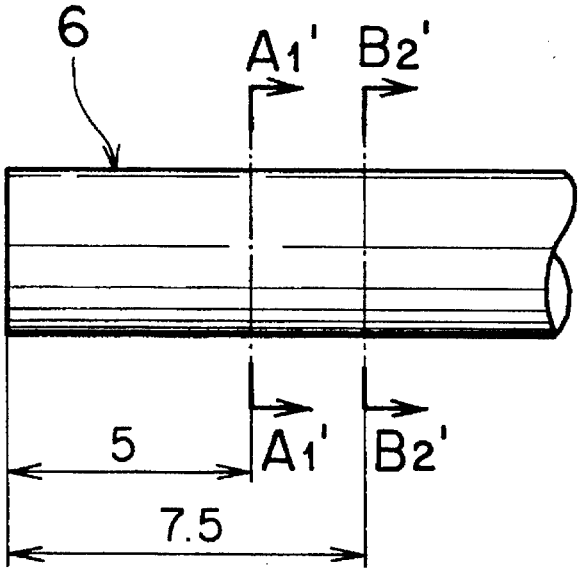
Figure 10A:
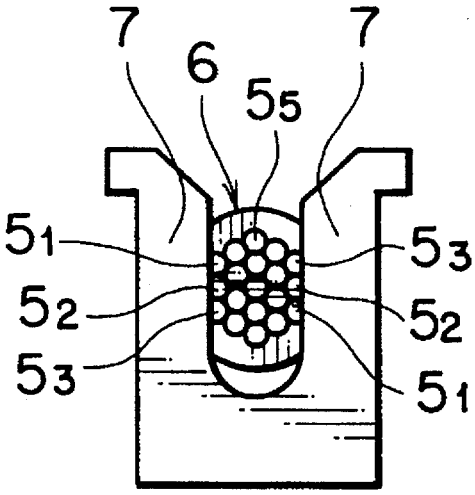
FIG. 10A and FIG. 10B are transverse cross sections showing a press-contacting state of the wires at the positions indicated in FIG. 9B.
Figure 10B:
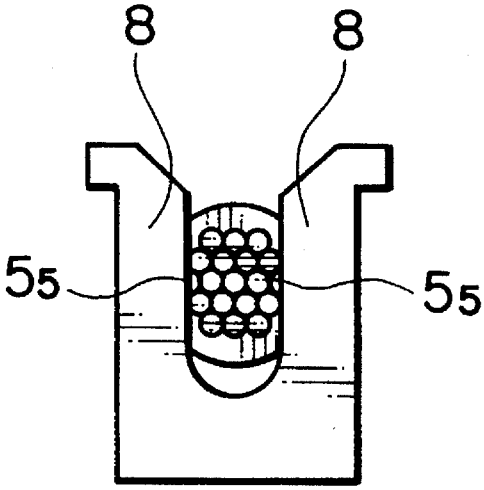

Moreover, as shown in FIGS. 7A and 7B, when the fore press-contacting piece 3 is positioned at C1—C1 section of a three-eighths strand pitch proceeding section (3.75 mm proceeding section) and the aft press-contacting piece 4 is located at D2—D2 section of a five-eighths strand pitch proceeding section (6.25 mm proceeding section), the pair of fore press-contacting piece 3,3 can, as shown in FIG. 8A, make contact with each couple of wires $1_2$, $1_3$ which are aligned in parallel to each other as inclining to a vertical line (wherein, the contacting force is larger in respect of the wire $1_2$ and smaller in respect of the wire $1_3$). While, the pair of aft press-contacting piece 4,4, as shown in FIG. 8B, make contact similarly with a couple of wires $1_1$, $1_3$ shifted by 90° in phase in comparison with that of FIG. 8A, which enables to get a larger continuity area.

In FIGS. 9 to 14, there is shown an example of a strand cable 6 composing of nineteen wires 5 (twelve wires in the first external layer) which is connected to a press-contacting terminal. When the strand pitch is 10 mm in length, as shown in FIGS. 9A and 9B, and the fore press-contacting piece 7 is positioned at A1'—A1' section of a one-half strand pitch proceeding section (5 mm proceeding section), the aft press-contacting piece 8 is located at B2'—B2' section of a three-quarters strand pitch proceeding section (7.5 mm proceeding section). As a result, the pair of fore press-contacting pieces 7,7 can, as shown in FIG. 10A, make contact with each three wires $5_1$ to $5_3$ to have a larger continuity area. While, the pair of aft press-contacting piece 8,8, as shown in FIG. 10B, make contact with only each one wire $5_5$, wherein the wire alignment is shifted by 90° in phase in comparison with that of FIG. 10A.

Figure 11A:
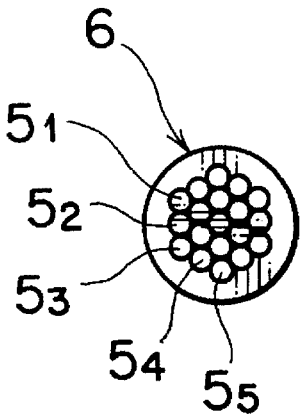
FIG. 11A is a front view of a strand cable and FIG. 11B is a top view showing longitudinal positions of sections proceeding a quarter or a half of the strand pitch in respect of the strand cable with nineteen wires in regard to this invention.
Figure 11B:
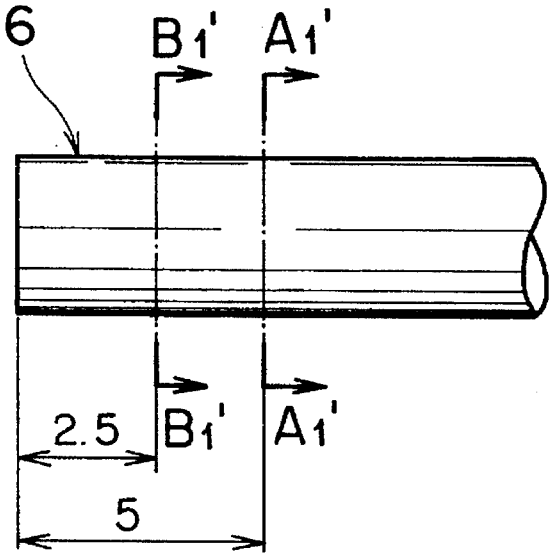
Figure 12A:
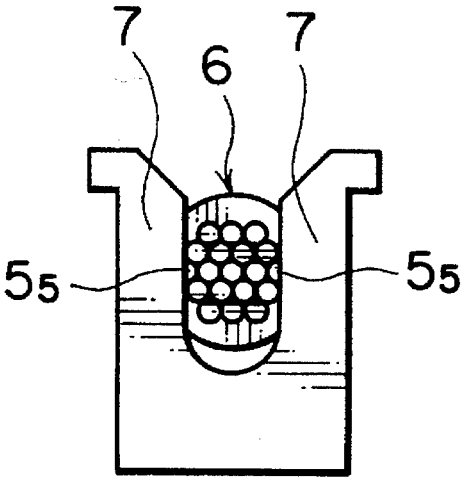
FIG. 12A and FIG. 12B are transverse cross sections showing a press-contacting state of the wires at the positions indicated in FIG. 10B.
Figure 12B:
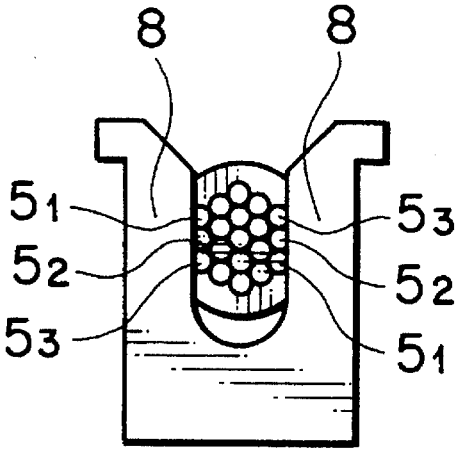

Further, as shown in FIGS. 11A and 11B, when the fore press-contacting piece 7 is positioned at B1'—B1' section of a one-quarter strand pitch proceeding section (2.5 mm proceeding section) and the aft press-contacting piece 8 is located at A1'—A1' section of a one-half strand pitch proceeding section (5 mm proceeding section), the pair of fore press-contacting piece 7,7 can, as shown in FIG. 12A, make contact with each one wire $5_5$. While, the pair of aft press-contacting piece 8,8, as shown in FIG. 12B, make contact with each three wires $5_1$ to $5_3$. B1'—B1' section is shifted by 180° in phase in comparison with B2'—B2' section in FIG. 10B.

Figure 13A:
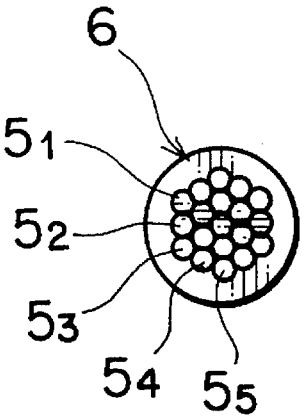
FIG. 13A is a front view of a strand cable and FIG. 13B is a top view showing longitudinal positions of sections proceeding by three eighths or five eighths of the strand pitch in respect of the strand cable with nineteen wires in regard to this invention.
Figure 13B:
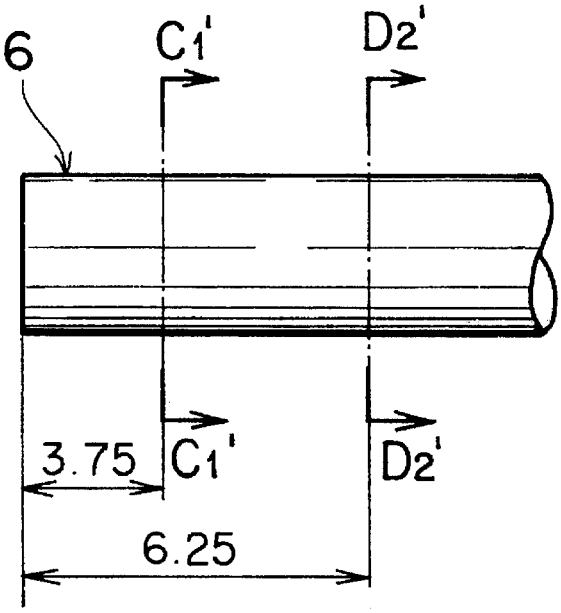
Figure 14A:
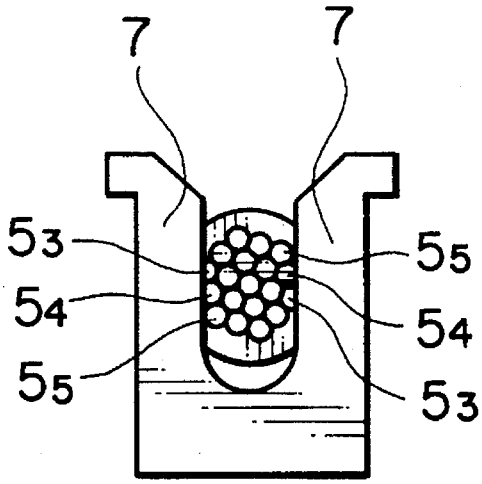
FIG. 14A and FIG. 14B are transverse cross sections showing a press-contacting state at the positions indicated in FIG. 13B.
Figure 14B:
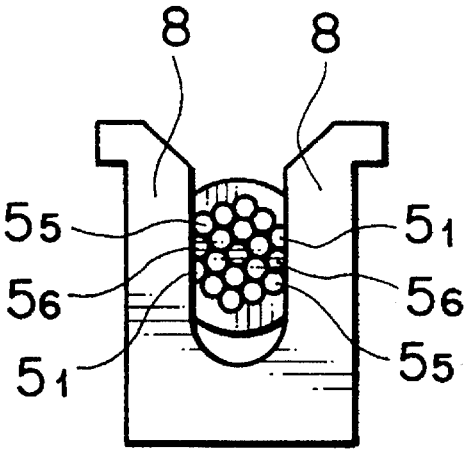

In FIGS. 13A and 13B, the fore press-contacting piece 7 is positioned at C1'—C1' section of a three-eighths strand pitch proceeding section (3.75 mm proceeding section) and the aft press-contacting piece 8 is located at A1'—A1' section of a five-eighths strand pitch proceeding section (6.25 mm proceeding section). The pair of fore press-contacting piece 7,7 can, as shown in FIG. 14A, make contact with each three wires $5_3$ to $5_5$ aligned with an inclination to a perpendicular. And, the pair of aft press-contacting piece 8,8, as shown in FIG. 14B, similarly make contact with each three wires $5_1$, $5_5$, and $5_6$. As a result, an appropriate electric continuity is achieved.

As mentioned above, a section in which only each one wire is positioned at each side portion of the strand cable and a section in which a plurality of wires are positioned at each side portion of the strand cable comes alternately at the every quarter strand pitch (90° in phase). Therefore, a general formula that determines an interval L of the fore and aft press-contacting pieces 3,4 or 7,8 according to a wire strand pitch P, is set up as follows;

$$L=P/4\times n \text{ (n is an odd number)}$$

And, if an interval L of the fore and aft press-contacting pieces 3,4 or 7,8 is determined to a quarter or three quarters of the strand pitch or so on, at least one of the fore and aft press-contacting pieces 3,4 (or 7,8) can make contact with a plurality of wires 1 (or 5) to get an appropriate electric continuity.

Figure 15:
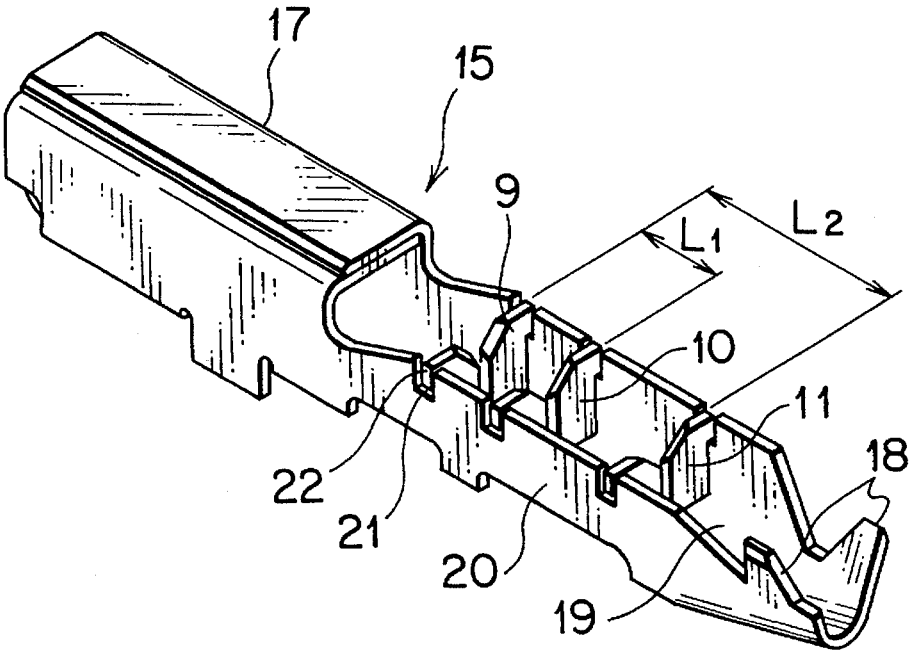
FIG. 15 is a perspective view showing an embodiment of a press-contacting terminals according to this invention.
Figure 16:
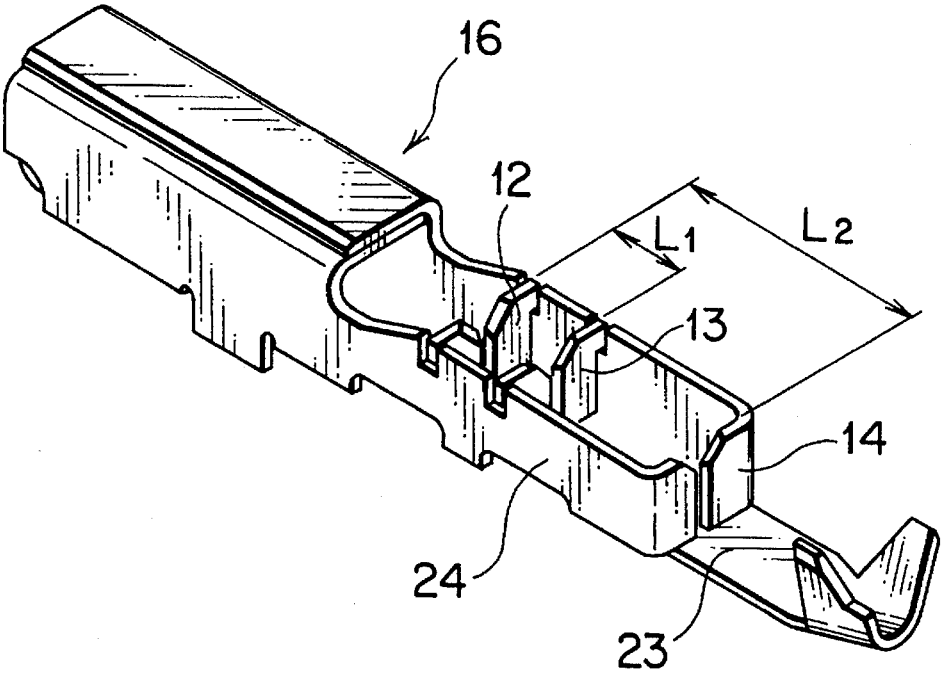
FIG. 16 is a perspective view showing an modified embodiment of FIG. 15.

In FIGS. 15 and 16, in regard to press-contacting terminals 15,16, according to the general formula to determine an interval of the fore and aft press-contacting pieces 3,4; L=P/4×n (n is an odd number), three right and left pairs of fore, middle, and aft press-contacting pieces 9 to 11 or 12 to 14 are positioned so as to make contact with every of two kinds of strand cables differed in strand pitches to get an appropriate electrical continuity.

For example, when one press-contacting terminal 15 (or 16) is utilized for both of a strand cable with a 10 mm strand pitch and another strand cable with a 24 mm strand pitch, an interval L1 of the fore and middle press-contacting pieces 9,10 (or 12,13) is determined to 2.5 mm, that is a quarter of 10 mm, and an interval L2 of the fore and aft press-contacting pieces 9,11 (or 12,14) is determined to 6 mm, that is a quarter of 24 mm. Thereby, the strand cable with 10 mm strand pitch can have a larger contact area pressed to at least one of the fore and middle press-contacting pieces 9,10 (or 12,13) and the strand cable with 24 mm strand pitch also can have a larger contact area pressed to at least one of the fore and aft press-contacting pieces 9,11 (or 12,14).

In FIG. 15, in respect of a strand cable press-contacting terminal 15, three pairs of fore, middle, and aft press-contacting pieces 9 to 11 are formed by rising up struck portions of a base plate 19 located between a front contact member 17 for another terminal and a rear clamping portion 18 for a insulation-covered cable. A projecting portion 22 formed on a side end of each pair of the press-contacting pieces 9 to 11 are engaged and fixed to a vertical slits 21 formed in each side plate 20.

In FIG. 16, in respect of a strand cable press-contacting terminal 16, two pairs of fore and middle press-contacting pieces 12, 13 are formed by cutting out and rising up a base plate portion 23 and a pair of aft press-contacting pieces 14 are formed by bending inwardly aft ends of both side plates 24.

The above mentioned press-contacting terminals 15,16 can be utilized for every of two kinds of cables differed in strand pitches. It is noted that, in regard to the pairs of the press-contacting pieces 9 to 11 (12 to 14), the number of pairs of the press-contacting pieces are not limited to three. More than three pairs of press-contacting pieces positioned longitudinally according to intervals L1, L2, L3, and so on that are determined by the above mentioned general formula can be arranged in a press-contacting terminal so that the press-contacting terminal can be commonly utilized also for more than two kinds of strand cables differed in strand pitches.

Accordingly, in respect of a strand cable press-contacting terminal according to this invention, an interval L of the fore and aft press-contacting pieces is determined in accordance with the formula; L=P/4×n (P; a strand pitch, n; an odd number). Therefore, whichever longitudinal part of the strand cable makes press-contact with the press-contacting pieces, at least one pair of fore and aft press-contacting pieces can always be able to make contact with a plurality of wires at each side portion of the strand cable to have a larger electric continuity area. As a result, it can avoid the above-mentioned drawback that every of fore and aft press-contacting pieces has a small contact area to a strand cable in some press-contacting positions of the strand cable, which achieves always an appropriate electric contact and an improved reliable electric connection.

Further, as more than two press-contacting pieces are provided longitudinally in the terminal at the interval L; L=P/4×n (P; a strand pitch, n; an odd number), corresponding to various kinds of strand cables differed in strand pitches, one press-contacting terminal can connect whichever of various kinds of strand cables. And, it avoid a complicated works that, corresponding to various strand pitches, a plural kinds of press-contacting terminal should be provided.

What is claimed is:

1. A strand cable press-contacting terminal for connecting thereto a strand cable comprising a plurality of twisted wires aligned in a first external layer of said cable, the plurality of twisted wires having a wire strand pitch, wherein an even number of the plurality of twisted wires are aligned in the first external layer of said cable, said terminal comprising:

a pair of fore and aft press-contacting pieces, arranged longitudinally in the terminal;

wherein said pair of fore and aft press-contacting pieces are spaced apart from each other a distance obtained by multiplying a quarter of the wire strand pitch by an odd number n.

2. A strand cable press-contacting terminal according to claim 1, wherein said fore and aft press-contacting pieces are spaced apart from each other a distance equal to a quarter of the wire strand pitch.

3. A strand cable press-contacting terminal according to claim 1, wherein six twisted wires are aligned in the first external layer of said cable.

4. A strand cable press-contacting terminal according to claim 1, wherein twelve twisted wires are aligned in the first external layer of said cable.

5. A strand cable press-contacting terminal according to claim 1:

wherein said cable further comprises insulation, the insulation covering said cable; and wherein said pair of aft press-contacting pieces forms an upwardly open notch, having an upper portion, for receiving said cable, the upper portion of said notch converging downwardly and having thin edges for shearing through the insulation of said cable.

6. A strand cable press-contacting terminal for connecting thereto a plurality of strand cables, each cable comprising a plurality of twisted wires aligned in a first external layer of said each cable, the plurality of twisted wires having a wire strand pitch, wherein the plurality of twisted wires of one of said plurality of strand cables has a different wire strand pitch than the plurality of twisted wires of another of said plurality of strand cables; and wherein an even number of the plurality of twisted wires are aligned in the first external layer of said each cable, said terminal comprising:

more than two pairs of press-contacting pieces, arranged longitudinally in the terminal at a plurality of distances apart from each other;

wherein each distance between adjacent pairs of said more than two pairs of press-contacting pieces is obtained by multiplying a quarter of said each wire strand pitch by an odd number n.

7. A strand cable press-contacting terminal according to claim 6:

wherein three pairs of press-contacting pieces are arranged longitudinally in the terminal;

wherein the plurality of strand cables is two strand cables; and wherein each distance between said three pairs of press-contacting pieces is a value equal to a quarter of said each wire strand pitch.

8. A strand cable press-contacting terminal according to claim 6;

wherein three press-contacting pieces are arranged longitudinally in the terminal;

wherein the plurality of strand cables is two strand cables; and wherein fore and middle press-contacting pieces are formed by rising up a struck portion of a bottom wall of the terminal and an aft press-contacting piece is formed by bending end portions of side walls of the terminal.

* * * * *